United States Patent [19]

von der Eltz

[11] Patent Number: 4,884,308

[45] Date of Patent: Dec. 5, 1989

[54] PROCESS FOR DYEING TEXTILE WOVENS OR KNITS MADE OF POLYESTER FIBERS OR MIXTURES THEREOF WITH OTHER FIBERS IN JET DYEING MACHINES

[75] Inventor: Hans-Ulrich von der Eltz, Frankfurt am Main, Fed. Rep. of Germany

[73] Assignee: Hoechst Aktiengesellschaft, Frankfurt am Main, Fed. Rep. of Germany

[21] Appl. No.: 209,540

[22] Filed: Jun. 21, 1988

[30] Foreign Application Priority Data

Jun. 23, 1987 [DE] Fed. Rep. of Germany ..... 3720697

[51] Int. Cl.[4] ..... D06B 3/28

[52] U.S. Cl. ..... 8/149.1

[58] Field of Search ..... 8/149.1, 149.2, 149.3, 8/152; 68/5 C, 177, 178

[56] References Cited

U.S. PATENT DOCUMENTS 3,762,866 10/1973 Rayment et al. ..... 68/5 C X
4,351,076 9/1982 von der Eltz et al. ..... 8/149.1
4,483,032 11/1984 Christ et al. ..... 68/5 C X
4,491,995 1/1985 Glander ..... 8/158

*Primary Examiner*—Philip R. Coe

[57] ABSTRACT

Process for dyeing textile wovens or knits made of polyester fibers or mixtures thereof with other fibers in jet dyeing machines.

The recently developed jet dyeing machines with aerodynamic fabric transport permit a drastic shortening of the liquor ratio and of the addition of higly concentrated dye solutions or dispersions directly into the driving gas circulation system under isothermal conditions. However, the prerequisite is dyes in finished form.

According to the invention, it has now been found that the costly finishing treatment is dispensible when nonfinished disperse dyes are dissolved highly concentratedly in suitable, preferably water-miscible, ecologically and toxicologically safe organic solvents, and these solutions are metered with the aid of the new technology specifically into the circulating gas stream to form a dispersion of the dyes which then produces a level dyeing on the textile material.

10 Claims, No Drawings

PROCESS FOR DYEING TEXTILE WOVENS OR KNITS MADE OF POLYESTER FIBERS OR MIXTURES THEREOF WITH OTHER FIBERS IN JET DYEING MACHINES

The present invention relates to a process for the isothermal, batchwise dyeing of textile material made of polyester fibers or of mixtures thereof with other fibers which is circulating in the form of an endless rope of woven or knitted fabric in a jet dyeing machine in an aqueous medium with hot-fixable colorants by the exhaust method, the forward drive for the transport of the fabric within the closed-loop jet machine via the actuation of the jet system being effected by means of the kinetic energy of a circulated gas stream which is not inert as regards the intended specific treatment effect, i.e. the coloristic behavior of dye and fiber material, and which, in the jet section for the fabric transport, is simultaneously admixed with the colorants in the form of an atomized formulation which, thus brought into contact with the textile material under the preselected temperature and pressure conditions, immediately take effect there in the fixing state.

A congeneric process where textile fabric ropes are subjected to wet finishing, in particular dyeing, in jet piece dyeing machines is described in European Patent Specification EP-B-0,078,022. However, the method which is described in said reference for the dyeing of textile material present in endless form and which permits the seamless transition between successive treatment phases under isothermal conditions without fabric stoppage, depends for its implementation on the use of products having expensively finished to form leveling disperse dyes; that is, the water-insoluble colorants after their chemical synthesis must first, before they are used, be brought into a dispersible or self-dispersing form by grinding and admixing relatively high amounts of dispersants. It is only by virtue of the state of fine division of dye species so treated that this conventional process is able to produce satisfactory dyeing results.

Yet German Patent Specification DE-C-3,210,380 discloses an exhaust process whereby textile wound packages which contain or consist of synthetic fibers are dyed with non-finished dyes. To this end, the water-insoluble dyes in question, without prior treatment with a finish oriented toward appropriate dyeing properties, are dissolved before use in water-miscible organic solvents and the solution thus obtained is then introduced into the circulating dye-free aqueous liquor already flowing through or around the textile material at the dyeing temperature. In the aqueous dyebath, the dye then precipitates from the organic solution in the form of a dispersion which is suitable for dyeing. This treatment, however, consumes comparatively large amounts of organic solvent, so that this specific process, which moreover is limited to dyeing apparatus permitting long liquor ratios, has failed to become established for cost reasons.

However, it is still one of the most urgent objectives in the field, albeit only in certain branches thereof, to dispense with the costly finishing of dyes, in particular as regards the growing importance of synthetic fibers in general and the production capacities for dyes, where the finishing stage has proved to be something of a bottleneck.

It is then the chief object of the invention described hereinafter to extend the principle of using dyes without a finish and apply this principle to modern jet dyeing techniques. The intention is to break new ground in the ever more important field of processing textile materials in jet dyeing machines.

As part of these efforts it has now been found that, by proceeding in line with the method of European Patent Specification EP-B-0,078,022, good dyeing results, especially as regards levelness, are obtainable by metering the colorants as a liquid formulation of non-finished, virtually water-insoluble or sparingly water-soluble dyes and/or pigments, in the form of a preferably highly concentrated solution in one or more organic solvents, into the driving gas stream, then, by exploiting the dilution effect brought on by the aqueous medium, precipitating the dissolved colorants in finely dispersed form on the textile material, and finally completing the dyeing under isothermal conditions.

This is because the utility of the present invention and hence the achievement of the advantages obtainable therewith rest on the fact that the aerodynamic fabric transport jet dyeing machines which have recently become available in the art permit a drastic shortening of the liquor ratio and also the addition of highly concentrated dye solutions or dispersions directly into the driving gas circulation system under isothermal conditions. A prerequisite for this was the very recent development of suitable metering means which permit the specific, accurately metered injection of even small quantities of liquid into the circulating gas stream. It was only on this basis that it was possible to test the idea of the invention in practice.

Even then, however, to arrive at the invention in question additionally a number of prejudices had to be surmounted:

First, it was a matter of deciding whether, in a situation where the dyes present in true solution come into contact for the first time with the fiber material when already under fixing conditions, exhibit at all any capability for achieving level dyeings or whether there is no chance of this from the outset.

Secondly, although it could be taken for granted that under less drastic conditions from the gas stream the level application of treating agents is possible, it was however extremely uncertain whether this would still be possible under the conditions of the invention, i.e. reduced quantities of liquor and extremely concentrated dye solutions. This is because it was absolutely necessary for the process that the solvent required be restricted to a minimum in order to meet economic or ecological considerations; that is, the metered addition of the small amount of dye solution must be accurately controlled in order to obtain a uniform primary distribution in the aqueous liquor present on the textile material.

The process itself accordingly takes the following form:

The textile material is introduced into the jet dyeing machine with simultaneously wetting and heating by the blower-generated steam/air stream and with the likewise simultaneous addition of the liquor required (within the range from 1.2:1 to 5:1 on weight of fiber), is sewn together into an endless rope and, after the jet has been closed, is set in further circulation by means of steam/hot air and brought to the selected dyeing temperature.

On the other hand, the nonfinished dye is dissolved in the proposed solvent in a separate vessel. Depending on the solvent, this solution is at a temperature from 70° to 150° C. and it can thus be introduced into the jet machine without major effect on the temperature of the dyeing system, i.e. under isothermal conditions.

This solution is then metered via a precision metering pump into the driving gas stream of the jet dyeing machine in such a way that always the same amount of solution is added per circulation of the textile material. The metered addition takes place under isothermal conditions over 5 to 10 circulations of the material to be dyed. Circulation is then continued at the dye temperature for a further 30 minutes, and the dyed fabric is then cooled down and aftertreated as desired.

According to the invention, this dyeing is possible at temperatures below 100° C., preferably between 90° and 100° C., under atmospheric pressure and also at temperatures above 100° C., preferably between 120° and 135° C., at the autogenous elevated pressure.

The organic solvents used for the process according to the invention are preferably those which, under the dyeing conditions employed, are at least partially soluble in or miscible with water and in which the pure dye and/or the pigment can be dissolved in a sufficiently high concentration. The dye or pigment is dissolved according to the process in the organic solvent at elevated temperature and metered into the liquor circulation from a hot makeup vessel. Examples of such solvents, which are used solo or mixed, are:

Alcohols such as 3-methoxybutanol, but in particular the glycols and ethers thereof or the esters of such glycol ethers such as glycol (monoethylene glycol), digiycol, triglycol, methylglycol, methylglycol acetate, methyldiglycol, ethylglycol, ethyldiglycol, ethyldiglycol acetate, propylglycol, n-butylglycol or n-butyldiglycol; ketones such as acetone, methyl ethyl ketone or diacetone alcohol; cyclic ethers such as tetrahydrofuran, tetrahydrofurfuryl alcohol or dioxane; esters and lactones such as glycol monoacetate, sec-butyl acetate, ethyl lactate or butyrolactone; low carboxylic acids such as formic acid or acetic acid; nitrogen-containing compounds, cyclic or acyclic, such as dimethylformamide, dimethylacetamide, pyridine, N-methylpyrrolidone or morpholine; and sulfur-containing compounds such as dimethyl sulfoxide. Particularly high suitability is possessed by polar, aprotic solvents. Of note are here dimethylformamide and dimethyl sulfoxide, which are particularly highly suitable on account of their solvent and physiologicalecological properties.

Also suitable are polyethylene glycols having a molecular weight of between 400 and 2,000, possibly still higher. Here too the dyes are dissolved in the hot polyglycol. Higher molecular weight polyglycols are first melted and the dye is then dissolved in the melt.

It is here immaterial for the claimed process whether the solvents used are or are not prone to foaming, since any foam can only form inside the textile material itself and if anything is more a help than a hindrance to the uniform distribution of the treating agent. This fact then counts as a further advantage in favor of the present process, since foaming in conventional jet machines has otherwise been identified as a cause of fabric transport problems and unlevel dyeings.

Finally, in the process the colorants can additionally be dissolved in water-immiscible and/or water-insoluble solvents, for example halogenated hydrocarbons, or in substances which act as carriers. If such types of solvents are used there are then two possible ways available for carrying out the process according to the invention: first, by metering the solution of the dye directly into the dyeing circulation system; secondly, by diluting the solution with hot water to produce a predispersion of the dye and then to meter in this predispersion. In either case, however, the halogenated hydrocarbons are reeliminated from the gas/liquor circulation system during the actual dyeing process, so that at the end of the dyeing no ecologically serious liquor residues on the fabric or in the jet machine survive. These halogenated hydrocarbons comprise chlorinated, fluorinated or mix-halogenated aliphatics of 1–4 carbon atoms.

The dyes used according to the invention are first and foremost disperse dyes which meet the abovelisted conditions in respect of solubility. Products of this type are known to the art and are described in the Colour Index, 3rd edition, 1971, volume 2 and supplements 1975 and 1982 under the class name "C.I. Disperse Dyes".

By constitution most of the disperse dyes are azo or anthraquinone compounds or, in a few cases, nitro or quinophthalone compounds.

In the claimed process, disperse dyes find application in the nonfinished state and are used for example in the form of presscakes, i.e. straight from the fabrication stage and before application of any finish as nonfinished fabrication (raw) material. However, besides the advantage of making it possible to use nonfinished dyes in PES exhaust dyeing, the present invention also makes it possible to obtain highly level dyeings even with those finished disperse dyes which were very difficult to dye level by the prior art exhaust processes.

The present invention also makes it possible to use pigments, provided they meet the requirements in respect of solubility, in particular organic pigments which as part of the novel process require no binder system as mediator for their bond to the fiber and which are classified in the Colour Index, 3rd edition 1971, volume 3 as "C.I. Pigments". Also suitable for the process are the products listed as "C.I. Solvent Dyes" in the Colour Index, 3rd edition 1971, volume 3.

To carry out the novel process, the abovementioned dyes and/or pigments (in the above-specified state) are dissolved in the maximum possible concentration in a solvent (of the above-defined type) or a mixture thereof, and this concentrated dye solution is injected with metering into the dyeing system over a certain period which corresponds with the circulation times of the textile material in the jet dyeing machine.

Compared with the nearest prior art the novel process has a number of advantages:

As nonfinished fabrication material, the pure dyes usable for dyeing are appreciably less costly than the finished commercial products. They need only be standardized to the same color strength.

It is possible to use in the process dyes and pigments which, in finished form and provided with a binder, respectively, hitherto appeared unsuitable for obtaining level dyeings on PES.

Since level dyeings are obtained rapidly, the dyeing time is shortened.

Moreover, the problem of foaming can be disregarded.

Since in most cases no or very little dispersant and/or leveling agent is mixed in with the dye solution in the makeup vessel or the circulating, blank liquor, there are consequently no corresponding residues on the fiber or in the bath. As a result, the aftertreatment of the dyed fabric is simpler and/or shorter.

For instance, in many cases no reduction clear is required and the dyeing need only be rinsed.

If no surfactants are present in the bath, the standing aqueous liquor remaining from the exhaustion of a first dyeing can readily be used for a further dyeing.

The dye penetration in the PES fibers in the process according to the invention is in most cases better than in the prior art processes.

The claimed process is very safe to carry out and provides very good reproducible dyeings because the metering of the dye solution is subject to automatic control.

Compared with the conventional process for dyeing from an aqueous dispersion, the organic solvent in the residual liquor and the attendant water pollution appears to be a disadvantage. However, it is to be noted in this context that the amount of such solvent in the liquor is very small, that in return in most cases no dispersants or leveling agents pass into the effluent with the residual liquor, and that it is possible, if desired, to dispense with a reduction clear.

The Examples which follow are intended to illustrate the principle of the process according to the invention without, however, restricting it especially as regards the solvents used, since they already constitute a selection of the most suitable solvents.

EXAMPLE 1

80 kg of a polyester knit are introduced into a jet dyeing machine of the type depicted in EP-B-0,078,022 by means of a steam/hot air mixture supplied to the jet system of said machine together with 120 liters of hot water (80° C.) and 3 $cm^3/l$ of 60% strength acetic acid and sewn together to form an endless rope. After the jet has been sealed off from the outside atmosphere, the textile material is set in motion by means of a steam/hot air mixture which itself is kept in circulation by the action of a blower, while at the same time the dyeing system including the textile material is heated to a dyeing temperature of 125° C. and then kept uninterruptedly at that temperature level by regulating the temperature of the driving gas mixture via a heat exchanger.

Separately, 640 g of the yellow disperse dye of the formula

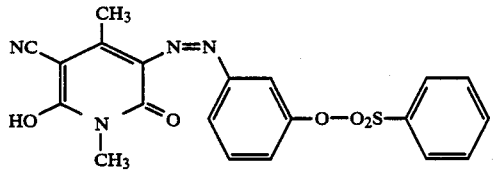

in pure, nonfinished form are dissolved at 110° C. in 4 liters of dimethylformamide. After the jet has been running for about 10 minutes, this solution is then injected into the hot gas stream via a metering pump in such a way that the metered addition of the liquid dye formulation is complete after 10 circulations of the textile material. The rope is then dyed for a further 30 minutes at a constant temperature, while its transport by the steam/hot air mixture is continued under the set temperature conditions.

At the end of the dyeing time the superatmospheric pressure of the circulating dyeing system is decreased by opening a so-called hot (HT) drain, and there is a marked cooling down and, owing to the then occurring evaporation of liquor in the textile material, a loosening thereof.

With subsequent addition of hot water (70° C.) into the jet which is then under atmospheric pressure, the dyed textile material is then initially rinsed hot while being kept in uninterrupted circulation by air circulated by the jet and the blower. Thereafter the dyeing obtained is as usual reduction cleared and rinsed once more hot and several times cold with water.

The result obtained is a level yellow dyeing on the polyester knit, which in the dyeing result obtained corresponds to a 2% strength dyeing with the same colored species but in finished commercial form.

EXAMPLE 2

A polyester/cotton blend fabric (70/30) which has previously been dyed with the dye C.I. Reactive Blue 21 in its cellulose fiber portion is to be cross-dyed with disperse dyes:

The 60 kg lot following the reactive dyeing is already in the jet and is circulated by air drive via the jet system. The web also contains 150 liters of water at 30° C. from the preceding treatment. By addition of 500 $cm^3$ of 60% strength acetic acid the rope material is made weakly acidic; thereafter, steam is blown in and at the same time the circulating air is heated by means of a heat exchanger in order to heat the textile material and liquor to 130° C. After about 5 minutes the temperature is the same everywhere in the dyeing system.

Separately, 63 g of the yellow disperse dye of Example 1 and 4 g of the blue disperse dye of the formula

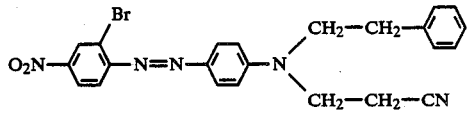

likewise in a nonfinished form, have in the meantime been dissolved in 1.5 liters of dimethylacetamide at 150° C. This solution is then metered at a uniform rate into the driving steam/hot air mixture at a constant temperature (130° C.) over 5 circulations of the continuously circulating textile material.

At the end of a further 20 minutes of treatment under the same conditions the dyeing is completed as in Example 1 by releasing the superatmospheric pressure and rinsing with hot and then cold water.

The result obtained is a turquoise/yellow two-tone effect on the fabric.

EXAMPLE 3

According to the invention, the dyeing of the polyester portion of the blend fabric of Example 2 can also be carried out at a treatment temperature of 100° C. under atmospheric pressure in the following manner:

Following the reactive dyeing of the cellulose fiber portion and the addition of acetic acid the fabric is then merely heated to 100° C. The same disperse dyes as specified in Example 2 are dissolved in the same quantities, but in this case in 700 $cm^3$ of a commercially available carrier based on methyl salicylate at 100° C., and this solution is then metered into the dyeing system as in Example 2. On completion of the metered addition an additional 2–3 liters of hot water are metered into the jet via the metering pump in order to carry all the carrier/-dye residues from the jet section into the circulating system. Following a further 30 minutes of dyeing at 100° C. the dyed fabric is rinsed with hot and cold water.

The dyeing result obtained is the same as in Example 2.

EXAMPLE 4

84 kg of a 100% polyester fiber fabric are introduced via a steam/hot air operated jet into a jet dyeing machine of the type depicted in EP-B-0,078,022 and at the same time moistened and impregnated with liquor by the addition of 170 liters of hot water (85° C.). The pH of the hot water has been set beforehand at pH 5 with acetic acid.

After the polyester fabric has been sewn together to form an endless rope the jet machine is sealed pressure-tight, and the transport of the fabric is set in motion by means of steam/hot air. By heating the steam/hot air mixture and blowing in further steam the dyeing system is finally heated to the treatment temperature of 125° C.

Separately, a mixture of 675 g of the blue disperse dye of the formula

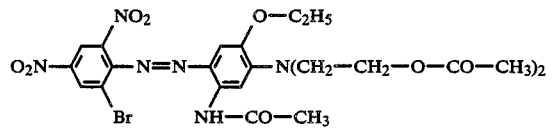

290 g of the yellow disperse dye of the formula

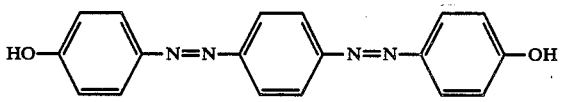

and 210 g of the yellow disperse dye of the formula

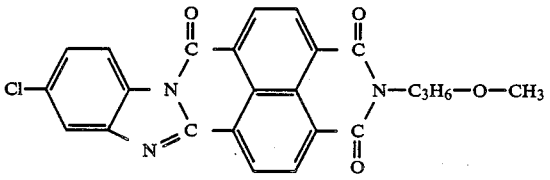

all three dye components of the mixture in pure, nonfinished form, has in the meantime been dissolved at 120° C. in 7 liters of polyethylglycol having a molecular weight of 600. This solution is then metered hot into the circulated gas stream in such a way that the metered addition proceeds at a uniform rate over 12 circulations of the textile material in the jet. The fabric is then dyed under the same temperature conditions for a further 30 minutes, then initially cooled down by pressure let down as in Example 1, then as usual rinsed with hot and cold water, reduction cleared and finally rinsed again with hot and cold water.

The result obtained is a level green dyeing of the fabric.

EXAMPLE 5

60 kg of a 100% polyester fiber fabric in rope form are introduced into a jet as in the preceding examples together with 100 liters of water at 80° C. The water has been set to pH 5. The circulating gas stream responsible for the fabric transport is admixed, after the temperature of the system has been brought to 130° C., with 2 liters of a solution of 30 g of the red disperse dye of the formula

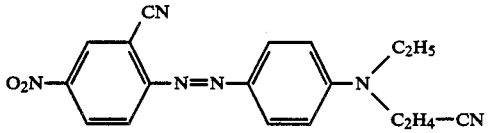

(in pure, nonfinished form) in perchloroethylene.

During the subsequent 30 minutes of dyeing at 130° C. the perchloroethylene is removed from the system via a bypass, and the dyeing is then completed by actuating a hot (HT) drain and rinsing with hot and cold water.

The result obtained is a level pink dyeing on the fabric.

I claim:

1. In a process for the isothermal, batchwise dyeing of textile material made of polyester fibers or of mixtures thereof with other fibers in an aqueous medium with hot-fixable colorants by the exhaust technique, comprising the steps of circulating the textile material in the form of an endless rope in a jet dyeing machine, propelling the textile material within a self-contained jet range of the machine by the kinetic energy of a circulated gas stream which is introduced into the machine, adding the colorants in the form of an atomized liquid formulation to the circulating gas stream to thereby bring the colorant formulation into contact with the textile material, and controlling the temperature and pressure and conditions of the gas stream and the liquid colorant formulation, the improvement comprising metering the colorants as a liquid formulation of non-finished, virtually water-insoluble or sparingly water-soluble dyes or pigments or of a mixture of both, in the form of a solution in one or more organic solvents, into the gas stream, precipitating the dissolved colorants in finely dispersed form on the textile material by exploiting the dilution effect brought on by the aqueous medium, and finally completing the dyeing under isothermal conditions.

2. The process as claimed in claim 1, wherein the organic solvent or solvents is or are water-miscible.

3. The process as claimed in claim 2, wherein a said organic solvent is dimethylformamide.

4. The process as claimed in claim 1, wherein the organic solvent or solvents is or are water-emulsifiable.

5. The process as claimed in claim 1, wherein a said organic solvent also acts as a carrier.

6. The process as claimed in claim 1, wherein the dyeing takes place at temperatures above 100° C.

7. The process as claimed in claim 6, wherein the dyeing takes place at a temperature between 120° and 135° C.

8. The process as claimed in claim 1, wherein the dyeing takes place at temperatures below 100° C.

9. The process as claimed in claim 8, wherein the dyeing takes place at a temperature between 90° and 100° C.

10. The process as claimed in claim 1, wherein the step of controlling the temperature and pressure conditions of the gas stream and the liquid colorant formulation is accomplished by applying a gas stream which is not inert as regards the intended specific treatment effect and to which the liquid colorant formulation is isothermally added to immediately become active upon contact with the textile material in the fixing state.

* * * * *